US006159563A

United States Patent [19]

Aycock Whitlock

[11] Patent Number: 6,159,563

[45] Date of Patent: Dec. 12, 2000

[54] UNWRAPPABLE FABRIC FLOWER WITH WAND STEM

[76] Inventor: Carla G. Aycock Whitlock, 1403 Red Oak Cir., Farmersville, Tex. 75442

[21] Appl. No.: 09/345,852

[22] Filed: Jul. 1, 1999

[51] Int. Cl.[7] ..... A01N 3/00; A41G 1/00

[52] U.S. Cl. ..... 428/26; 428/24; 428/4

[58] Field of Search ..... 428/24, 26, 17, 428/15, 4, 7, 542.2, 542.4; 156/61

[56] References Cited

U.S. PATENT DOCUMENTS 1,766,351 6/1930 Patterson .
1,942,174 1/1934 Kaplan .
3,146,153 8/1964 Stein .
4,963,411 10/1990 Protz, Jr. .
5,236,748 8/1993 Cheng .
5,314,730 5/1994 Flores .

*Primary Examiner*—Deborah Jones
*Assistant Examiner*—Wendy Boss

[57] ABSTRACT

A unwrappable fabric flower with wand stem for providing a wedding or party novelty and wand keepsake includes a decorative keepsake wand having a removable flexible material wrapped therearound to form a flower.

12 Claims, 3 Drawing Sheets

UNWRAPPABLE FABRIC FLOWER WITH WAND STEM

BACKGROUND OF THE INVENTION

1. Field of the Invention

The present invention relates to artificial flowers and more particularly pertains to a new unwrappable fabric flower with wand stem for providing a wedding novelty and wand keepsake.

2. Description of the Prior Art

The use of artificial flowers is known in the prior art. More specifically, artificial flowers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,767,650; U.S. Pat. No. 3,603,196; U.S. Pat. No. 4,333,778; U.S. Pat. No. 4,772,343; U.S. Pat. No. 4,708,893; and U.S. Pat. No. Des. 304,021.

While these devices fulfill their respective, particular objectives and requirements, the aforementioned patents do not disclose a new unwrappable fabric flower with wand stem. The inventive device includes a decorative keepsake wand having a removable flexible material wrapped therearound to form a flower.

In these respects, the unwrappable fabric flower with wand stem according to the present invention substantially departs from the conventional concepts and designs of the prior art, and in so doing provides an apparatus primarily developed for the purpose of providing a wedding novelty and wand keepsake.

SUMMARY OF THE INVENTION

In view of the foregoing disadvantages inherent in the known types of artificial flowers now present in the prior art, the present invention provides a new unwrappable fabric flower with wand stem construction wherein the same can be utilized for providing a wedding novelty and wand keepsake.

The general purpose of the present invention, which will be described subsequently in greater detail, is to provide a new unwrappable fabric flower with wand stem apparatus and method which has many of the advantages of the artificial flowers mentioned heretofore and many novel features that result in a new unwrappable fabric flower with wand stem which is not anticipated, rendered obvious, suggested, or even implied by any of the prior art artificial flowers, either alone or in any combination thereof.

To attain this, the present invention generally comprises a decorative keepsake wand having a removable flexible material wrapped therearound to form a flower.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new unwrappable fabric flower with wand stem apparatus and method which has many of the advantages of the artificial flowers mentioned heretofore and many novel features that result in a new unwrappable fabric flower with wand stem which is not anticipated, rendered obvious, suggested, or even implied by any of the prior art artificial flowers, either alone or in any combination thereof.

It is another object of the present invention to provide a new unwrappable fabric flower with wand stem which may be easily and efficiently manufactured and marketed.

It is a further object of the present invention to provide a new unwrappable fabric flower with wand stem which is of a durable and reliable construction.

An even further object of the present invention is to provide a new unwrappable fabric flower with wand stem which is susceptible of a low cost of manufacture with regard to both materials and labor, and which accordingly is then susceptible of low prices of sale to the consuming public, thereby making such unwrappable fabric flower with wand stem economically available to the buying public.

Still yet another object of the present invention is to provide a new unwrappable fabric flower with wand stem which provides in the apparatuses and methods of the prior art some of the advantages thereof, while simultaneously overcoming some of the disadvantages normally associated therewith.

Still another object of the present invention is to provide a new unwrappable fabric flower with wand stem for providing a wedding novelty and wand keepsake.

Yet another object of the present invention is to provide a new unwrappable fabric flower with wand stem which includes a decorative keepsake wand having a removable flexible material wrapped therearound to form a flower.

Still yet another object of the present invention is to provide a new unwrappable fabric flower with wand stem that is distributable to wedding guests to replace traditional wedding guest participatory activities that are currently disallowed or otherwise disfavored such as throwing rice, birdseed, confetti, blowing bubbles, ringing bells or lighting sparklers.

Even still another object of the present invention is to provide a new unwrappable fabric flower with wand stem that is highly visible in wedding photos.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
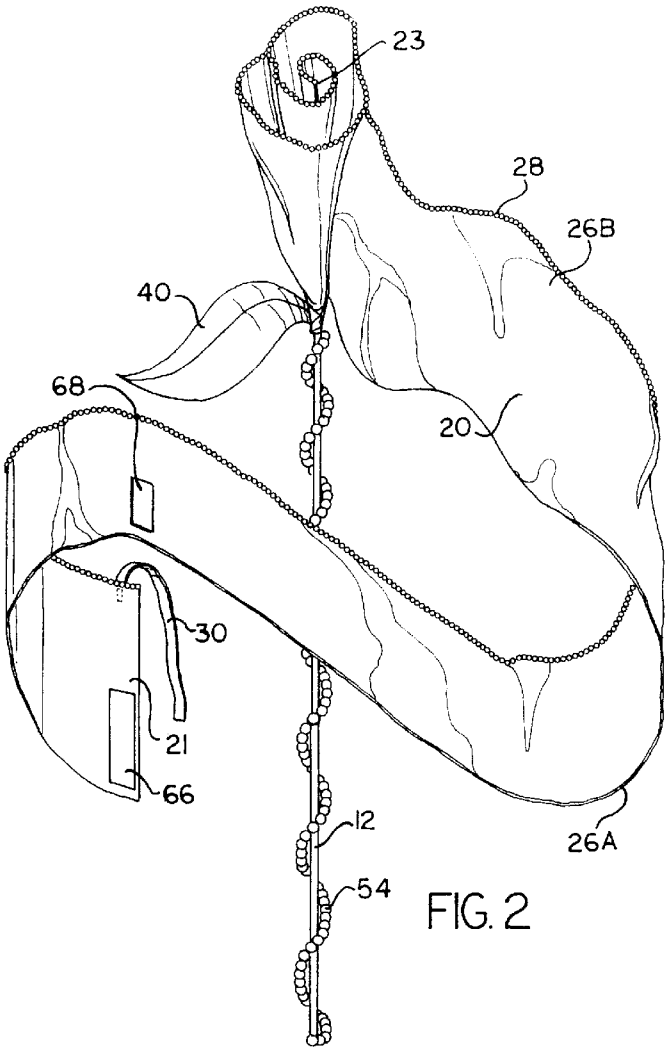
FIG. 2 is a schematic perspective view of the present invention.
Figure 1:
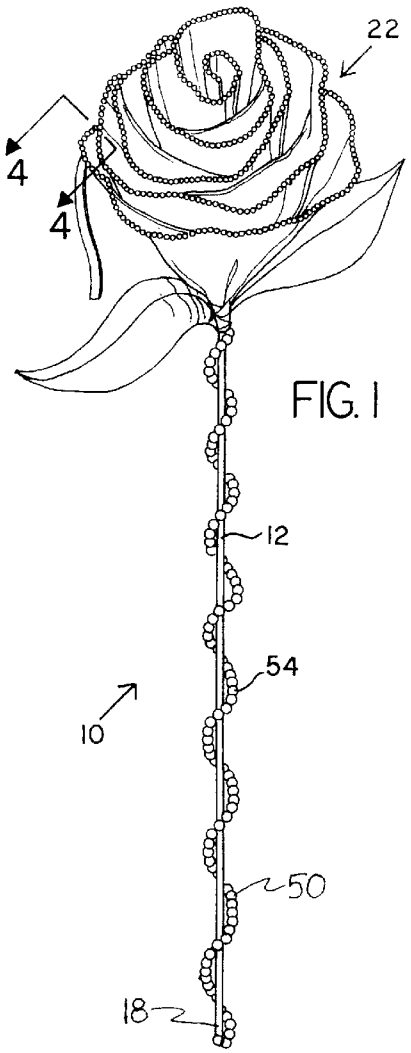
FIG. 1 is a schematic perspective view of a new unwrappable fabric flower with wand stem according to the present invention.
Figure 3:
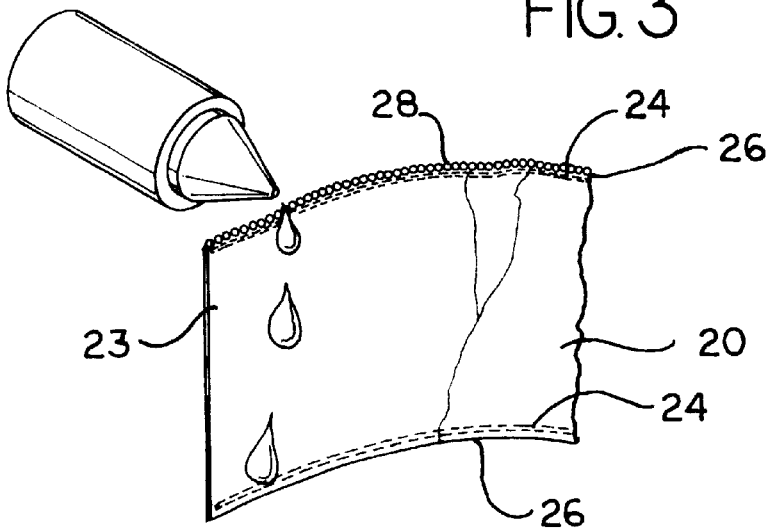
FIG. 3 is a schematic perspective view of an end of the ribbon of the present invention.
Figure 4:
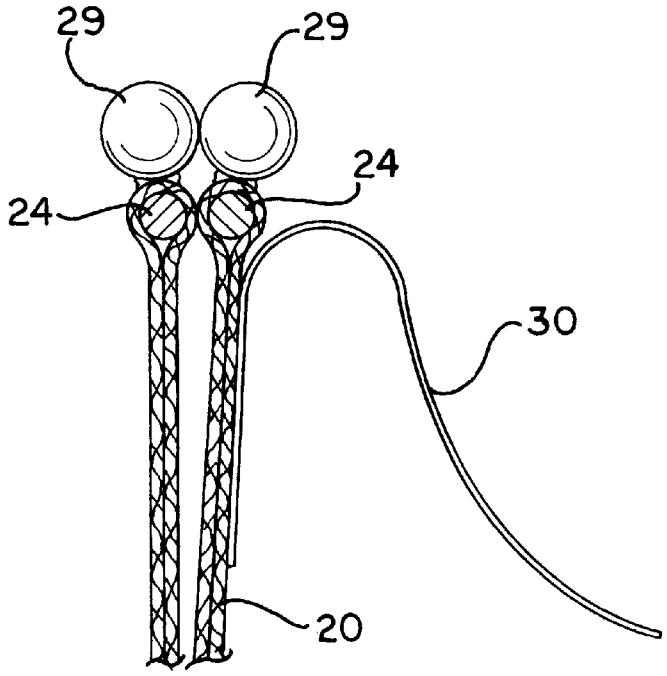
FIG. 4 is a schematic cross-sectional view taken along line 4—4 of FIG. 1.
Figure 5:
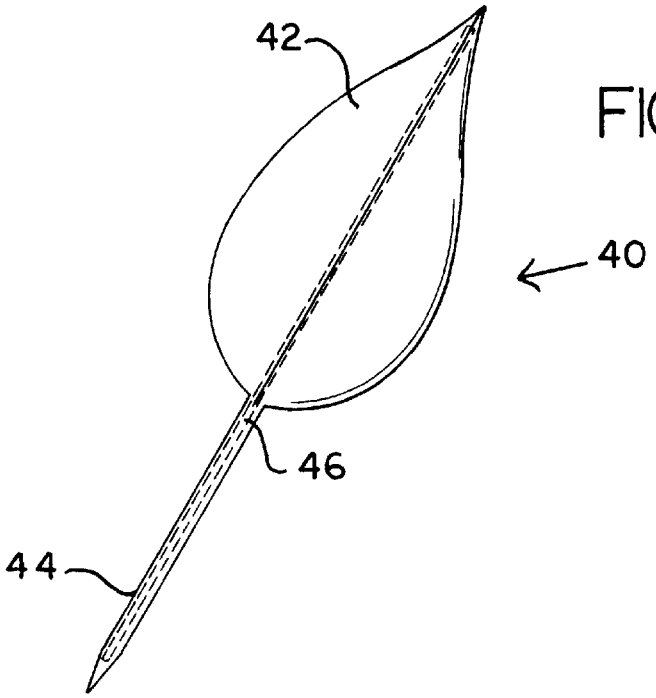
FIG. 5 is a schematic perspective view of a leaf member of the present invention.
Figure 6:
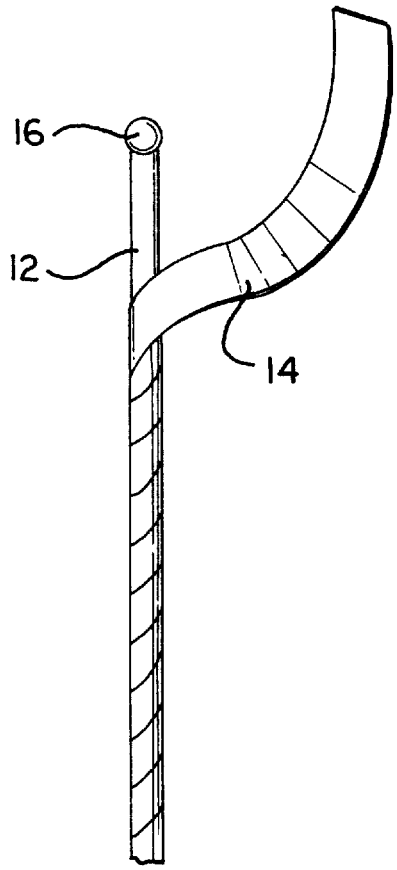
FIG. 6 is a schematic front view of the wrapped wand of the present invention.

With reference now to the drawings, and in particular to FIGS. 1 through 6 thereof, a new unwrappable fabric flower with wand stem embodying the principles and concepts of the present invention and generally designated by the reference numeral 10 will be described.

As best illustrated in FIGS. 1 through 6, the unwrappable fabric flower with wand stem 10 generally comprises a wand 12, a ribbon 20 wrapped around a head 16 of the wand, and a tab 30 coupled to an end 21 of the ribbon to facilitate unwrapping the ribbon from the wand.

The wand is optionally wrapped in a decorative wrapping material 14 to complement the ribbon. Optionally, the wrapping material is self-adhesive to facilitate wrapping around the wand.

The ribbon is wrapped around the wand head such that the wrapped ribbon forms a flower member 22 at the head of the wand. The tape may be wrapped around the wand after positioning the ribbon so that the tape extends partially onto the base of the wrapped ribbon to assist in removably holding the ribbon around the wand.

The ribbon includes a pair of wires 24 disposed therein for facilitating shaping of the wrapped ribbon to form the flower member. Each of the wires 24 is disposed proximate to and extends parallel to a respective longitudinal edge 26 of the ribbon. A first one of the longitudinal edges 26A of the ribbon is wrapped around the wand such that a second one of the longitudinal edges 26B is distally positioned relative to the wand.

In an embodiment, a decorative edge member 28 is disposed along the second longitudinal edge of the ribbon. Optionally, the decorative edge member can comprise a plurality of decorative orbs 29 resembling opals, pearls, other minerals or jewels, or any combination of known decorative minerals and/or jewels.

A first end of the ribbon 23 is coupled to the wand by glue applied to the first end proximate a corner formed by the first end and the first longitudinal edge of the ribbon. The corner is attached to the wand prior to wrapping the ribbon around the wand.

In an embodiment a number of leaf members 40 are attached to the wand and positioned as desired. Each leaf member includes a broad portion 42 and a stem portion 44.

The stem portion of each the leaf member includes a flexible non-resilient wire core 46 extending into the broad portion for facilitating positioning of the broad portion relative to the wand. The stem portion is optionally wrapped around a base of the wrapped ribbon for facilitating retention of the shape of the flower member.

A decorative line 50 is optionally wrapped around a base of the flower member for facilitating retention of the shape of the flower member. The line generally extends downwardly circling around the wand from the base of the flower member to a distal end 18 of the wand.

Optionally, the line is a strand of decorative line members 54 and each of the decorative members may be configured to resemble a pearl such that the line resembles a strand of pearls.

The tab is coupled to a second end of the ribbon 21 for facilitating unwrapping of the ribbon from the wand. The tab is optionally hot glued to the ribbon whereby pulling the tab facilitates unwrapping of the ribbon from the wand to reveal the wand which may be waved ceremonially to a parting married couple. The wand itself is optionally designed in a decorative nature to provide a keepsake of the wedding.

Optionally, hook and loop fasteners 60 may be positioned proximate the second end 21. Upon wrapping the ribbon, a first portion of the hook and loop fasteners 66 may be coupled to the ribbon in a position complementary to a second portion 68 of the hook and loop fasteners complementary to the first portion. Thus, the first and second portions 66 and 68 may be engaged to each other to hold the second end 21 of the ribbon in place until the tab is pulled.

While the above invention has been described as pertaining to a wedding event, it is fully contemplated that the invention could be employed equally for other parties or events including birthday parties, sporting events, and the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An unwrappable fabric flower comprising:

a wand;

a ribbon wrapped around a head of said wand, said ribbon being wrapped around said wand head such that said wrapped ribbon forms a flower member coupled to said wand;

a tab coupled to an end of said ribbon, said tab being for facilitating unwrapping of said ribbon from said wand;

a first end of said ribbon being coupled to said wand; and said tab being coupled to a second end of said ribbon opposite said first end such that said tab extends freely from said flower member when said ribbon is wrapped to form said flower member to permit grasping of said tab for facilitating pulling of said tab away from said wand whereby said ribbon is unwrapped.

2. The unwrappable fabric flower of claim 1, further comprising:

said ribbon having a pair of wires disposed therein for facilitating shaping of said wrapped ribbon, each of said wires being disposed proximate a respective longitudinal edge of said ribbon.

3. The unwrappable fabric flower of claim 2, further comprising:

a first one of said longitudinal edges of said ribbon being wrapped around said wand such that a second one of said longitudinal edges of said ribbon is distally positioned relative to said wand; and a decorative edge member being disposed along said second longitudinal edge of said ribbon.

4. The unwrappable fabric flower of claim 1, further comprising:

at least one leaf member, each said leaf member having a broad portion and a stem portion, said stem portion being wrapped around a base of said wrapped ribbon for facilitating retention of a shape of said flower member.

5. The unwrappable fabric flower of claim 4, further comprising:

said stem portion of each said leaf member having a flexible non-resilient wire core extending into said broad portion for facilitating positioning of said broad portion relative to said wand.

6. The unwrappable fabric flower of claim 1, further comprising:

said ribbon having a pair of longitudinal edges;

a first one of said longitudinal edges of said ribbon being wrapped around said wand such that a second one of said longitudinal edges of said ribbon is distally positioned relative to said wand; and said first end being coupled to said wand by glue applied to said first end proximate a corner formed by said first end and said first longitudinal edge of said ribbon.

7. The unwrappable fabric flower of claim 1, further comprising:

a line wrapped around a base of said flower member such that said line is snugly secured around said base of said flower member for facilitating retention of a shape of said base of said flower member.

8. The unwrappable fabric flower of claim 7, further comprising:

said line extending downwardly around said wand from said base of said flower member; and said line being a strand of decorative line members.

9. The unwrappable fabric flower of claim 8, further comprising:

each of said decorative members being configured to resemble a pearl whereby said line resembles a strand of pearls.

10. The unwrappable fabric flower of claim 1, further comprising:

said wand being wrapped in a covering material.

11. An unwrappable fabric flower comprising:

a wand wrapped in a covering material;

a ribbon wrapped around a head of said wand, said ribbon being wrapped around said wand head such that said wrapped ribbon forms a flower member coupled to said wand;

said ribbon having a pair of wires disposed therein for facilitating shaping of said wrapped ribbon, each of said wires being disposed proximate a respective longitudinal edge of said ribbon;

a first one of said longitudinal edges of said ribbon being wrapped around said wand such that a second one of said longitudinal edges of said ribbon is distally positioned relative to said wand;

a decorative edge member being disposed along said second longitudinal edge of said ribbon;

at least one leaf member, each said leaf member having a broad portion and a stem portion, said stem portion being wrapped around a base of said wrapped ribbon for facilitating retention of a shape of said flower member;

said stem portion of each said leaf member having a flexible non-resilient wire core extending into said broad portion for facilitating positioning of said broad portion relative to said wand;

a first end of said ribbon being coupled to said wand;

said first end being coupled to said wand by glue applied to said first end proximate a corner formed by said first end and said first longitudinal edge of said ribbon;

a line wrapped around a base of said flower member such that said line is snugly secured around said base of said flower member for facilitating retention of a shape of said base of said flower member;

said line extending downwardly around said wand from said base of said flower member;

said line being a strand of decorative line members;

each of said decorative members being configured to resemble a pearl whereby said line resembles a strand of pearls; and a tab coupled to an end of said ribbon, said tab being for facilitating unwrapping of said ribbon from said wand, said tab being coupled proximate a second end of said ribbon opposite said first end of said ribbon such that said tab extends freely from said flower member when said ribbon is wrapped to form said flower member to permit grasping of said tab for facilitating pulling of said tab away from said wand whereby said ribbon is unwrapped, wherein said tab is hot glued to said ribbon whereby pulling said tab facilitates unwrapping of said ribbon from said wand.

12. An unwrappable fabric flower comprising:

a wand wrapped in a covering material;

a ribbon wrapped around a head of said wand, said ribbon being wrapped around said wand head such that said wrapped ribbon forms a flower member coupled to said wand;

said ribbon having a pair of wires disposed therein for facilitating shaping of said wrapped ribbon, each of said wires being disposed proximate a respective longitudinal edge of said ribbon;

a first one of said longitudinal edges of said ribbon being wrapped around said wand such that a second one of said longitudinal edges of said ribbon is distally positioned relative to said wand;

a decorative edge member being disposed along said second longitudinal edge of said ribbon;

at least one leaf member, each said leaf member having a broad portion and a stem portion, said stem portion being wrapped around a base of said wrapped ribbon for facilitating retention of a shape of said flower member;

said stem portion of each said leaf member having a flexible non-resilient wire core extending into said broad portion for facilitating positioning of said broad portion relative to said wand;

a first end of said ribbon being coupled to said wand;

a line wrapped around a base of said flower member such that said line is snugly secured around said base of said flower member for facilitating retention of a shape of said base of said flower member;

said line extending downwardly around said wand from said base of said flower member;

said line being a strand of decorative line members;

each of said decorative members being configured to resemble a pearl whereby said line resembles a strand of pearls; and a tab coupled to an end of said ribbon, said tab being for facilitating unwrapping of said ribbon from said wand, said tab being coupled proximate a second end of said ribbon opposite said first end of said ribbon such that said tab extends freely from said flower member when said ribbon is wrapped to form said flower member to permit grasping of said tab for facilitating pulling of said tab away from said wand whereby said ribbon is unwrapped.

* * * * *